US005163372A

United States Patent [19]

Galvan et al.

[11] Patent Number: 5,163,372

[45] Date of Patent: Nov. 17, 1992

[54] UNIT FOR ACTUATING GATES OF A HOPPER RAILROAD CAR

[75] Inventors: Guadalupe L. Galvan, DeKalb; Robert T. Fischer, Homewood, both of Ill.

[73] Assignee: Miner Enterprises, Inc., Geneva, Ill.

[21] Appl. No.: 785,366

[22] Filed: Oct. 30, 1991

[51] Int. Cl.[5] ..... B61D 7/00

[52] U.S. Cl. ..... 105/240; 105/250; 105/282.1; 105/286; 105/287; 105/289

[58] Field of Search ..... 105/240, 241.1, 247, 105/250, 252, 280, 282.1, 286, 287, 288, 289, 290, 296, 299, 308.1, 308.2, 309, 310; 222/561, 559, 504, 509, 502, 503; 49/339, 340, 345, 363

[56] References Cited

U.S. PATENT DOCUMENTS

| | | | |
|---|---|---|---|
| 1,629,853 | 5/1927 | Wright | 105/240 |
| 3,371,826 | 1/1967 | Speno | 105/240 |
| 3,408,956 | 11/1968 | Rebenok et al. | 105/296 |
| 3,650,221 | 3/1972 | Nagy | 105/299 |
| 3,710,730 | 1/1973 | Austgen et al. | 105/240 |
| 3,786,764 | 1/1974 | Beers et al. | 105/250 |
| 3,868,913 | 3/1975 | Becker et al. | 105/240 |
| 3,981,539 | 9/1976 | Proechl et al. | 105/240 |
| 4,222,334 | 9/1980 | Peterson | 105/250 |
| 4,452,149 | 6/1984 | LeMarbe | 105/250 |
| 4,454,822 | 6/1984 | Fischer | 105/250 |
| 4,601,244 | 7/1986 | Fischer | 105/240 |
| 4,742,628 | 5/1988 | Cicin-Sain | 37/105 |

FOREIGN PATENT DOCUMENTS

| | | | |
|---|---|---|---|
| 0372099 | 3/1973 | U.S.S.R. | 105/240 |
| 0515681 | 5/1976 | U.S.S.R. | 105/240 |
| 1576385 | 7/1990 | U.S.S.R. | 105/286 |
| 1595721 | 9/1990 | U.S.S.R. | 105/286 |
| 1614994 | 12/1990 | U.S.S.R. | 105/286 |

*Primary Examiner*—Douglas C. Butler
*Assistant Examiner*—Mark T. Le

[57] ABSTRACT

One double acting cylinder is attached to the doors of a gate assembly via a linkage. A lock out system cooperates with the linkage whereby different parts of the linkage may be immobilized prior to the beginning of a work cycle. The work performed by the double acting cylinder thus passes through the free parts of the linkage to actuate one door or the other.

9 Claims, 4 Drawing Sheets

UNIT FOR ACTUATING GATES OF A HOPPER RAILROAD CAR

BACKGROUND OF THE INVENTION

This invention relates to gate assemblies used with hopper-type railroad cars and more particularly a retrofitable power-actuating device which permits a selective opening and closing of the inner or outer doors employing a single air cylinder valve.

Gate assemblies and devices for opening and closing the inner and outer door are well known in the industry. For example, U.S. Pat. No. 4,454,822 to Robert T. Fischer discloses one such assemblage. For the most part, such gate assemblies have employed manually actuated gate opening and closing devices. What this means is that the operator must manually insert a steel bar, for example, into the gate actuation linkage to actuate the desired door in the desired direction and then move down the track at the speed with which the train is moving to maintain control. As is apparent, anyone who has attempted to move rapidly down the side of a railroad track knows the difficulty created by the tie spacing and the rough ballast. If one imagines that to further complicate his efforts he must hold at least one hand on the steel bar to hold it in the gate actuation linkage, the over-all scope of the job can be better appreciated. Of course, while the operator is attempting to negotiate his own course down the side of the track, he must also monitor the flow of ballast and deposit it in the volume needed only in those places required. Obviously, in this age of increased concern for workers' safety, such a system for ballast discharge is not totally acceptable. At the same time, other factors must be considered, such as the complexity and reliability of the mechanism, as well as its cost.

SUMMARY OF THE INVENTION

The power operator assembly of this invention is designed to be retrofitable to gate assemblies such as that disclosed in U.S. Pat. No. 4,454,822 to Fischer, or incorporated into newly constructed gate assemblies. The type of gate assembly to which it can be affixed depends primarily on the nature and location of the inner and outer door output shafts. In the preferred consideration hereafter more fully discussed, a double acting cylinder and a linkage system is incorporated in connection with a lock-up system. Upon actuation of the selected lock-out means, the closed center valve will open or close the inner or outer door a preselected amount. Moving parts are few and since only one air cylinder and valve is employed, the costs are also attractive. An additional feature is that the closed center valve has a control lever located at a point mid-center on the ballast car. From this point, the operator can monitor and control the flow of ballast without being in the direct path of the falling rock and associated dust and debris. Further, the control means can be set so that crushed stone will be dropped from the doors at a particular rate or the operator can manually manipulate the control lever to change or stop flow.

The means, which is the subject of this invention, includes a double actuating valve which can be selectively employed to rotate either the inner or the outer door shafts of a hopper-type railroad car. As is apparent by rotating the particular door shaft, the inner or outer door can be opened or closed. It should be appreciated that the actual gate assembly and railroad hopper car are standard in the art. The particular form of gate assembly employed herein as a preferred embodiment is shown in U.S. Pat. No. 4,454,822 issued to Robert T. Fischer on Jan. 19, 1984. Metal pie-shaped brackets called the first and second torque transfer levers or operating hub assemblies, are secured to the end of the inner and outer door shafts. As stated, the transfer levers are generally pie-shaped and thus have three corners. In the preferred embodiment, the corner which occupies the apex of the pie-shaped wedge is that corner which is secured to the corresponding door shaft. Another corner as occupied by a means which allows immobilization of the torque transfer lever and the last and third corner is occupied by a connector means. The two connector means, that is, the one on the first torque transfer lever and the one on the second torque transfer lever, are joined through linkage means to a single acting linear actuator. In this particular embodiment, the means for immobilizing the torque transfer lever is simply a notch cut in the corner thereof. This notch cooperates with a finger secured to a handle which allows selective engagement or disengagement. Both the first torque transfer lever and the second torque transfer lever have their own cooperating fingers located at the end of separate handles.

In practice, when it is desired to open one of the two doors, the handle is rotated and it associates finger is disengaged from the immobilizing means located on the chosen torque transfer lever. At the same time, the immobilizing means on the other torque transfer lever is engaged with its associated locking finger. The linear actuator is then engaged and force is transferred to the torque transfer lever and thus through the door shaft and to the corresponding door. The door can be opened to any position between full open and full closed and held there. By venting the actuator to the atmosphere the door can be driven in the reversed direction by gravity or air power until it is closed.

Means for rotating the inner and outer door shaft of this invention provide an important advantage over previous heretofore known assemblies. Primarily of which is that one double action linear actuator can be employed to selectively open and close one or the other of the two doors. Another important advantage is that a means is provided to allow high initial breakaway force at the start of the stroke of the linear actuator. The gate can also be opened or closed manually using a box wrench on the hex nuts which are integrally mounted on each of the operating shafts at opposite ends from the cylinder.

DESCRIPTION OF THE DRAWINGS

Further advantages and features of the present invention will become more apparent from a description of several embodiments thereof taken in conjunction with the accompanying drawings in which.

DESCRIPTION OF THE PREFERRED EMBODIMENT

Figure 5:
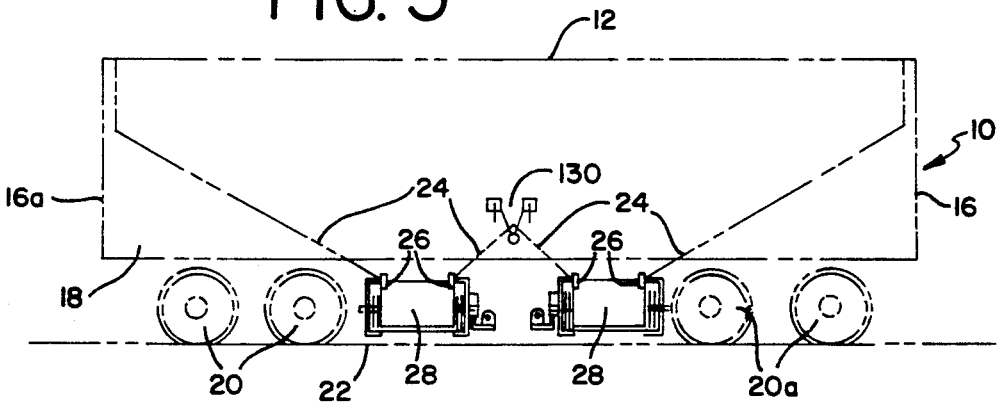
FIG. 5 is a side elevation view of a hopper-type railroad car to which the means for rotating the output shafts has been installed.

A hopper-type railroad car is shown generally in FIG. 5 and designated 10. The car 10 includes a body 12 defined by spaced sidewalls with one such sidewall shown and designated 14. The sidewall 14 joins end walls 16 and 16*a*. A bottom 18 of the body 12 is supported in a known manner by trucks 20 and 20*a* shown pictorially. Wheels of the trucks 20 engage a pair of rails with one such rail 22 shown.

To facilitate gravity unloading of contents of the car body 12, the car bottom 18 is formed in part by sheets 24 which slope downward and terminate at lower outlets 26. Typically, the car body 12 is formed with four outlets 26, with two such outlets being aligned with the rail 22 and the other two outlets (not shown) aligned with the other rail (not shown). Attached below each outlet 26 is a gate assembly unit 28.

All the gate assembly units 28 are similar in construction and therefore only one gate need be described in detail. This description is best understood by concurrently viewing FIGS. 1-6. The unit 28 includes a pair of spaced end panels 30 each welded with a top horizontal flange 32 and a formed bottom horizontal flange 34. Joined to the bottom flanges 34 adjacent to the outer vertical edges of each panel 30 are one of a pair of longitudinal angles 38. Each angle 38 is offset so that a leg portion 40 of each angle 38 engages an underside of the inner and outer deflectors 42, 44 of a divider panel 46. The deflectors 42, 44 slope upwardly and join to form a leading horizontal edge 48 or inverted "V". The panel 46 also includes pairs of vertical end flanges 50 formed at a right angle to the deflectors 42 and 44 respectively.

The gate assembly unit 28 further includes spaced end walls 52. Each end wall 52 fastens to the car bottom sloped end segments 70. Each end wall 52 includes a vertical rectangle-shaped portion 56. The vertical rectangle-shaped portions 56 have downwardly sloped flanged edges 59.

Joining the end walls 52 are inner and outer sidewalls 62 and 64. Each sidewall 62, 64 also has an upper outwardly sloped attaching flange 66 which fastens to the car bottom sloped side sheets 24. Each sidewall 62, 64 further includes an upper vertical portion having ends which join the end walls 52. Extending downwardly from each sidewall upper vertical portion are sloped end segments 70 which respectively define therebetween an inner and outer opening 72, 74 in the unit 28.

Figure 1:
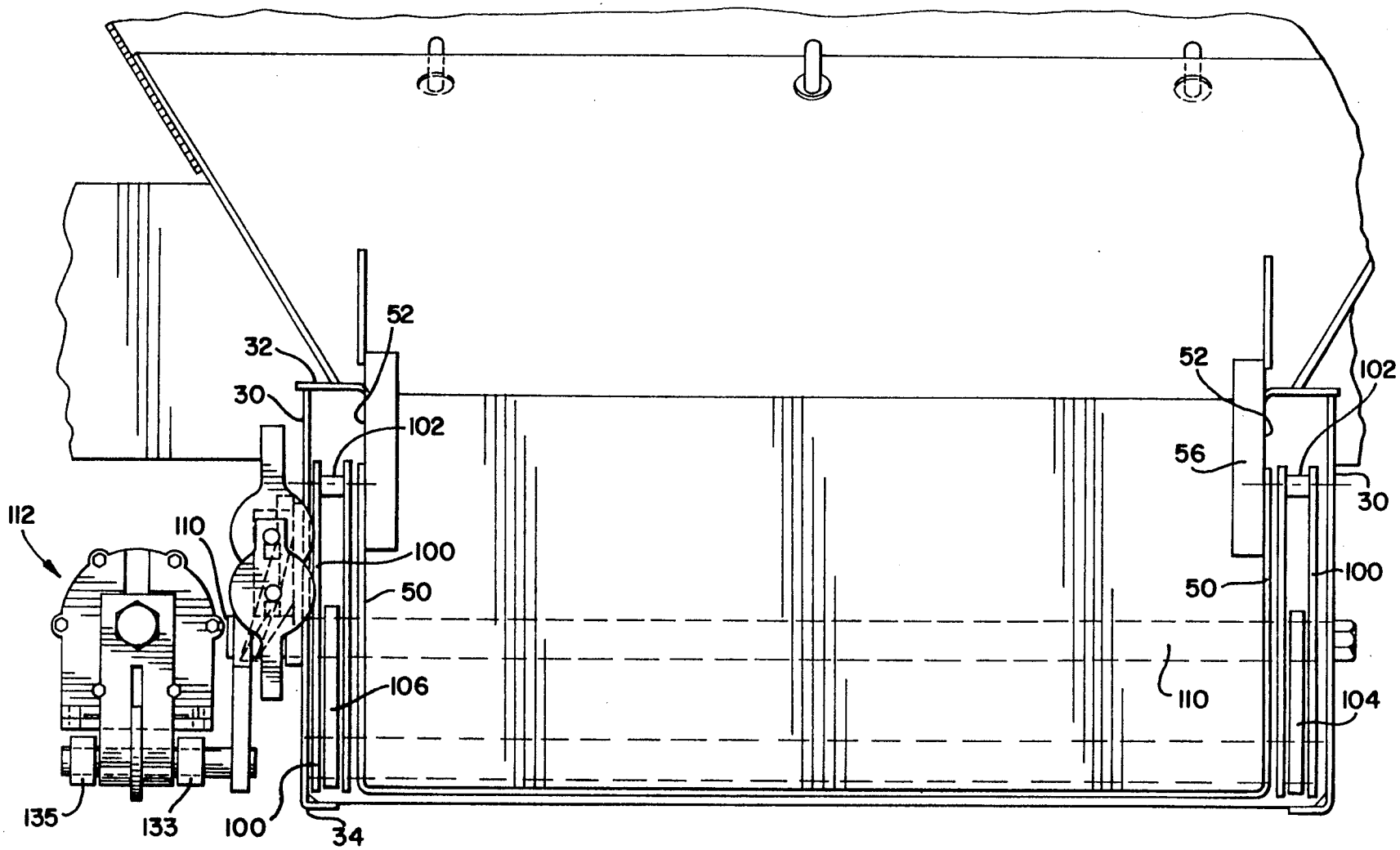
FIG. 1 is a detailed side elevational view, partially in section, of the gate assembly to which this invention has been installed.
Figure 2:
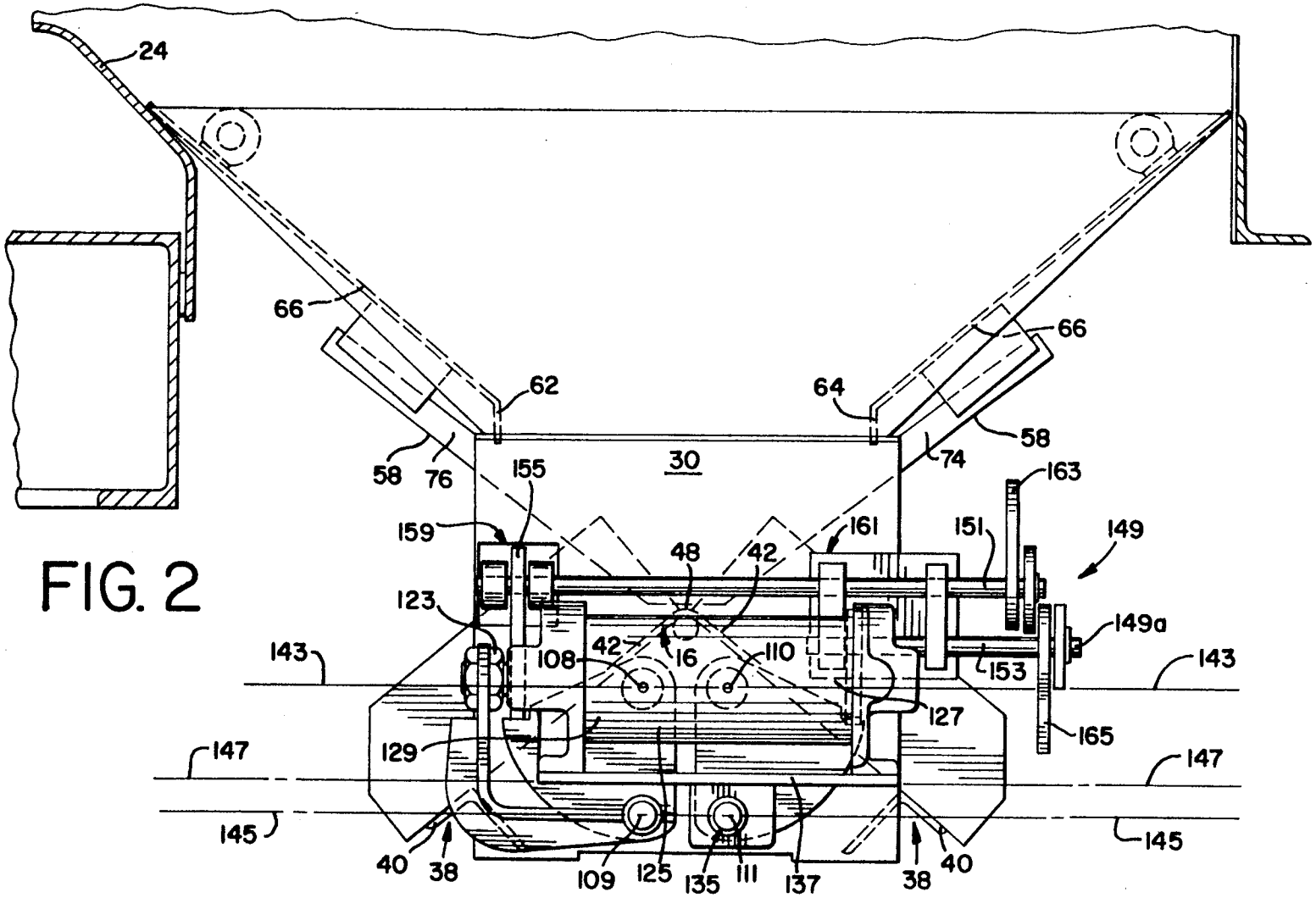
FIG. 2 is a detailed end elevation view of FIG. 1 as viewed from the left showing both doors in the closed position.

As best seen in FIGS. 1 and 2, the end wall flanged edges 58 and the sidewall end flanges 50 are spaced apart and sloped at a slightly different angle to form inner and outer downwardly converging door guides 76, 75. End portions 79 of an inner and outer door 80, 82 are disposed in these guides 76, 75. Construction of the doors 80, 82 is best understood by viewing FIGS. 3 and 4. Each door 80, 82 has a face plate 84 formed with a bottom offset lip portion. Attached to an outer side of each door face plate is an angle 88. For a discussion of the door construction employed herein, reference should be made to U.S. Pat. No. 4,454,822 to Robert T. Fischer dated Jun. 19, 1984 which is incorporated herein.

Attached to the door pivot rods 96 of the inner and outer door 80, 82 are ends of pairs of inner and outer door linkage arms 98, 100. A spacer 102 located on each rod 96 maintains the pairs of arms 98, 100 in a spaced relationship. Opposite ends of the linkage arm pairs 98, 100 are pivotally attached to ends of inner and outer door toggle arms 104, 106. Opposite ends of the toggle arms 104, 106 are, in turn, fastened to an inner and an outer door shaft 108, 110. Ends of these shafts 108, 110 are journaled in bearing devices attached respectively to the end panels 30.

Figure 3:
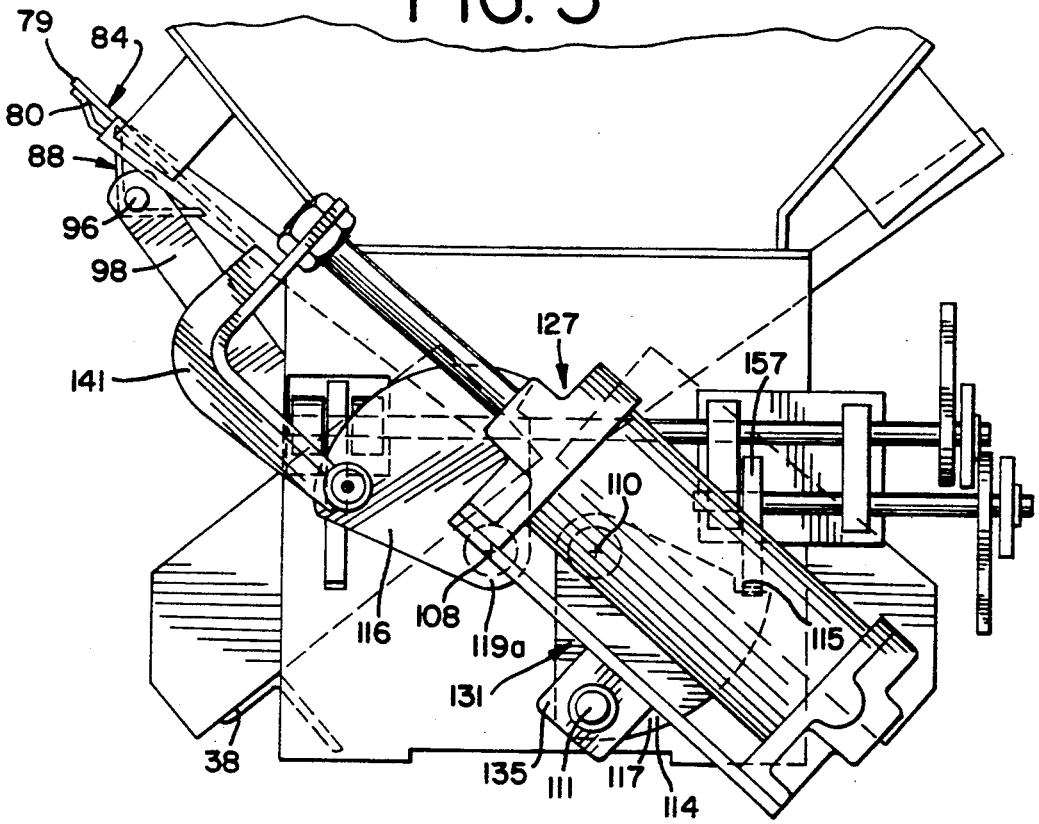
FIG. 3 is an end elevation view of the gate assembly with a portion cutaway as generally seen from the left of FIG. 1 showing the inner door in an open position.
Figure 4:
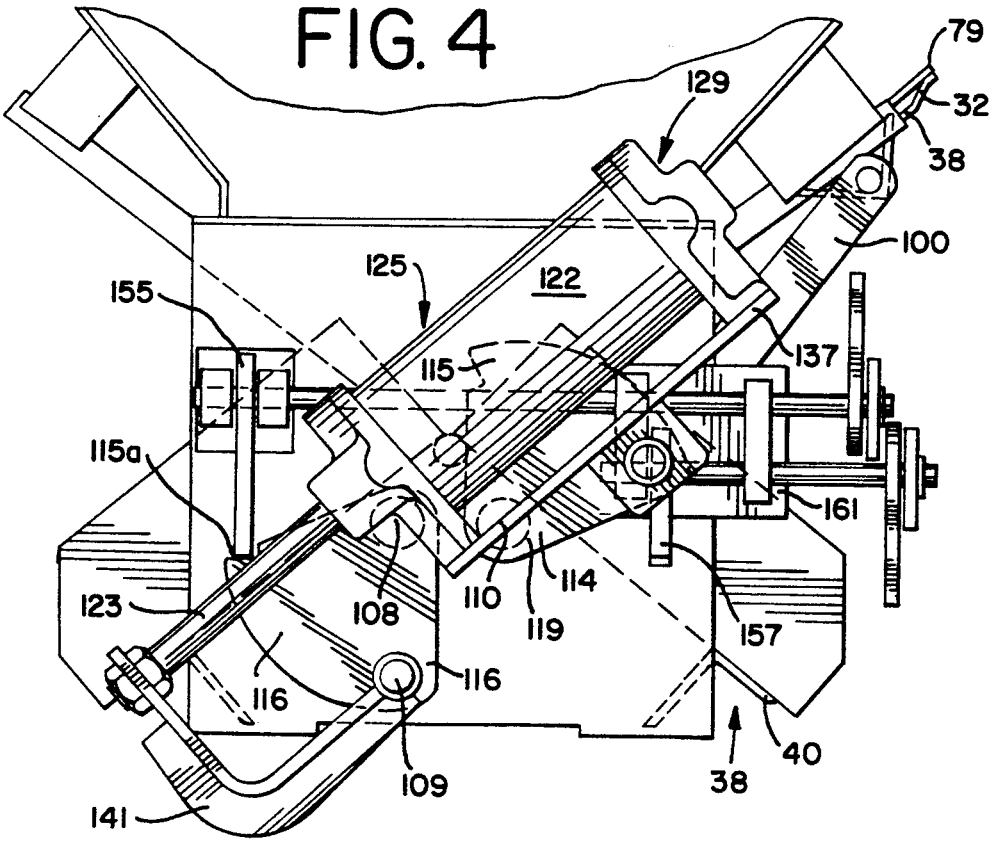
FIG. 4 is an end elevation view as is FIG. 3 showing the outer door in an open position.

Respecting FIGS. 3 and 4, it will be explained that upon actuation of the motor means 112 selectively either the inner or the outer door shaft may be rotated. Upon rotation of the door shaft via the linkage mechanisms, the corresponding inner or outer door will be open or closed. What has been provided and will be hereafter described is a means for rotating the two different shafts to accomplish door control.

Initially the individual components will be described beginning with the first and second torque transfer lever means 114 and 116. The first torque transfer lever means 114 in a preferred embodiment is generally three cornered or wedge-shaped structures. Located at different corners are: a first means for immobilizing 115; a first torque transfer means 117; and a securing point means 119 whereby the first torque transfer lever is secured to the output shaft 110. The second torque transfer means 116 is substantially identical but in the reverse and includes a second torque transfer lever means 115*a*, a second means for mobilizing 114*a* and a securing point means 115*a* for securing the second torque transfer lever 116 to the inner door shaft 108. From a consideration of FIGS. 2, 3 and 4, it is apparent that both the first and second torque transfer lever means 114 and 116 sweep out circular arcs around the center of their respective door shafts 110 and 108.

Figure 6:
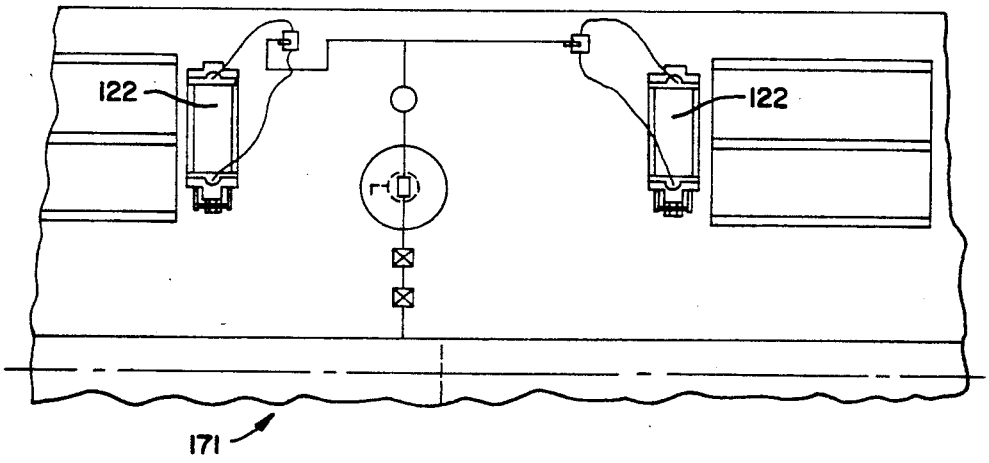
FIG. 6 is a partial view showing a schematic of the pneumatic system.

A motor means 112 is provided to supply the needed force to rotate the inner 108 and outer 110 door shafts. In the preferred embodiment, the motor means is a double acting pneumatic cylinder 122 having an output rod 123, a cylinder tube 125 and a front end 127 and back end 129. All of the necessary pneumatic system 171 is shown in FIG. 6 and since these mechanisms are standard in the industry and therefore no further discussion will be directed thereto, other than to note the location of the control 130.

A means for carrying 131 the motor is provided and includes connectors 133 and 135 for securement to the first 114 and second 116 torque transfer lever brackets and a base frame 137. It should be noted that the connector 135 is located below the base frame 137 and slightly to the right of center of the means for carrying as shown in FIG. 2. Referring to FIG. 3, it should be apparent that when the outer door shaft 110 is rotated, the motor and the means carrying it, are rotated around point 111. In FIG. 4 it should be apparent that when the inner door shaft 108 is rotated, the motor and the means carrying it are rotated around point 109. In both situations, the position shown in FIG. 2 is considered to be the starting position.

In a preferred embodiment, the rod end 123 of the motor means is secured through a pivot arm 141 to the second 116 torque transfer means.

Referring now to FIG. 2 wherein both the inner and outer doors are closed, particular geometric relationships will be discussed. Firstly, a series of planes will be identified, the first 143 of which extends along the center of the rod 123. The second 145 extends from left to right through the points 109 and 111. The third 147 extends down the center from left to right of the base frame 137. All three of these planes are parallel and spaced apart and will remain so all through a work cycle involving either the opening or the closing of the inner or the outer door.

Still another element in the means for rotating the inner 108 and outer 110 door shafts is the means for directionally indexing 149 and 149*a* or gate lock which cooperates with the first 115 and second 115*a* means for immobilizing to allow either movement or immobilization of the inner 108 or outer 110 door shaft. The means for directional indexing 149 and 149*a* include first 151 and second 153 shafts, first 155 and second 157 locking fingers, first 159 and second 161 support brackets and first 163 and second 165 means for securing a position once achieved. In the preferred embodiment, these last elements are weighted bars or counter weights which once moved into a position resists movement in any other direction.

Turning now to the mode of operation, first the opening and closing of the outer door via the rotation of shaft 110 will be discussed which involves considerations of FIGS. 2 and 4. Initially, the locking finger 157 is rotated out of engagement with the first means for immobilizing 115. It should be noted that the first 115 and second 115*a* means for mobilizing in the preferred embodiment are a notch cut into the wedge-shaped torque transfer lever. Then the control means 130 shown in FIG. 5 is actuated allowing a supply of compressed air to enter the motor means 112. With respect to both locking fingers and both the first and second means for immobilizing a small gap has been provided between each. That is, either operating hub assembly can move a small amount before the locking finger and the means for immobilizing cooperate to prevent any further movement. Returning now to the steps of operation, upon actuation of the control means a supply of compressed air passes into the cylinder 122 and the rod 123 begins to extend. Because of the gap, the rod 123 is moving when the second torque transfer lever 116 is secured by the combination of the locking finger 155 and the means for immobilizing 115*a*. There has thus been provided a break-open feature in that the rod 123 is moving at the time it attempts to break open the door against the load of material, for example, crushed stone within the body of the hopper car. With respect to the inner door, an identical system exists involving the first means for immobilizing 115 and the second locking finger 157. This assembly takes advantage of the gap provided so that the rod end is also moving as the linkages lock up and the door is thus smoothly forced open against the load.

A final feature of the invention can be appreciated if we take the first example of operation given above. That is, the example wherein the first torque transfer lever 114 is rotated to open the outer door beginning in FIG. 2 and is finalized in FIG. 4. The first and second torque transfer levers 114 and 116 for rotating the inner and outer door shaft are designed to return to the rest position shown in FIG. 2 reversing flow of the compressed air to the double acting cylinder. But, as is appreciated, the second locking finger 155 and the second means for immobilizing 115*a* will remain so wedged. What is needed in the system is a mechanism whereby the gaps can be fully restored in order to initiate the next work cycle and allow movement of the locking fingers. This is accomplished through the provision of the connector 135 being slightly to the right of the center of the base frame 137 in combination with the linkages and their corresponding door means and the leading horizontal edge 48. As is previously stated in the final rest position, the various horizontally extending spaced-apart parallel planes will all return to the position shown in FIG. 2. Also, once the compression air is vented, the action of the double acting cylinder and gravity will pull the corresponding door and all relative parts downward whereby closing the door. However, approximately one to two degrees of travel before achieving the geometric relationship shown in FIG. 2, the lip of the door contacts the leading horizontal edge 48. Force is thus directed backwards between from the leading horizontal edge into the door through the linkage, back through the torque transfer lever, which moves the means for immobilizing slightly away from the locking finger to create the gap necessary to start the next work cycle.

The various embodiments of the invention are set forth above by way of example. It will be appreciated by those skilled in the art that modifications can be made to the method and apparatus of this invention without departing from the spirit and scope of the invention as set forth in the accompanying claims.

What is claimed is:

1. In a hopper-type railroad car having a gate assembly including inner and outer door shafts and corresponding doors, a means for rotating the inner and outer door shafts whereby opening and closing the corresponding doors of the gate assembly comprising:

first and second lever means, said first lever means having a first lock accepting means and said second lever means having a second lock accepting means;

said first lever means being secured to said outer door shaft and said second lever being secured to said inner door shaft;

a motor having an output means attached to said second lever;

means carrying said motor which is rotatably secured to said first lever means; and first and second lock means for selective engagement with said first or second lock accepting means whereby which ever of said first or second lock accepting means not engaged by said lock means is rotated as well as said inner or outer shaft so as to open or to close the corresponding door.

2. The means for rotating the inner and outer door shafts of claim 1 further characterized by said first lever means having a first force transfer connection means and said second lever means having a second force transfer connection means, said means carrying said motor is secured to said first force transfer connection means whereby rotation is possible therebetween, and said output means is secured to said second force transfer connection means whereby rotation is possible therebetween.

3. The means for rotating the inner and outer door shafts of claim 2 wherein said first and second lever means are generally three-cornered structures wherein said connector means is located at one of said three corners, said lock accepting means means is located at another of said corners and said door shaft is secured to the third of said three corners.

4. The means for rotating the inner and outer door shafts of claim 3 wherein said motor is a double acting pneumatic cylinder.

5. In a hopper-type railroad car having a gate assembly including inner and outer door shafts and corresponding doors, a means for rotating the inner and outer door shafts, whereby opening and closing the corresponding doors of the gate assembly comprising:

a first torque transfer lever means secured to said outer door shaft including a first connector means and a first lock accepting means whereby said first torque transfer lever means may be immobilized;

a second torque transfer lever means secured to said inner door shaft including a second connector means and a second lock accepting means whereby said second torque transfer lever means may be immobilized;

a double acting motor means having an output lever, said output lever being rotatably secured to said second connector means;

a means carrying said motor means which is secured to said first connector means whereby when said means carrying is rotated around and supported by said first torque transfer lever means; and means for direction indexing which cooperate with said first and second lock accepting means for immobilizing said first and second torque transfer lever means, whereby upon actuation of said motor means, said inner and outer door shafts may be selectively rotated.

6. The means for rotating of claim 5 wherein said motor means and said means carrying said motor means, each have a major axis, all of said major axes being parallel and spaced apart.

7. The means for rotating of claim 5 wherein said first torque transfer lever means is secured to and rotates around said outer door shaft, said second torque transfer lever means is secured to and rotates around said inner door shaft and said means carrying said motor means is secured to said first connector means and rotates therearound.

8. The means for rotating of claim 5 wherein between said means for direction indexing and first and second lock accepting means, is a gap whereby upon actuation, said motor can move prior to lockup.

9. The means for rotating of claim 8 wherein said motor means is a double acting cylinder.

* * * * *